US008506321B2

(12) United States Patent
Hanyu et al.

(10) Patent No.: US 8,506,321 B2
(45) Date of Patent: Aug. 13, 2013

(54) CONNECTOR

(75) Inventors: Takuji Hanyu, Setagaya (JP); Koji Chikano, Setagaya (JP)

(73) Assignee: Molex Incorporated, Lisle, IL (US)

( * ) Notice: Subject to any disclaimer, the term of this patent is extended or adjusted under 35 U.S.C. 154(b) by 70 days.

(21) Appl. No.: 13/314,364

(22) Filed: Dec. 8, 2011

(65) Prior Publication Data

US 2012/0184127 A1 Jul. 19, 2012

(30) Foreign Application Priority Data

Dec. 16, 2010 (JP) ..... 2010-280021

(51) Int. Cl.
*H01R 13/62* (2006.01)

(52) U.S. Cl.
USPC ..... 439/370

(58) Field of Classification Search
USPC ..... 439/370, 352, 489, 372, 345, 374
See application file for complete search history.

(56) References Cited

U.S. PATENT DOCUMENTS

| | | | | |
|---|---|---|---|---|
| 5,145,356 | A * | 9/1992 | Minnis | 439/352 |
| 6,217,345 | B1 * | 4/2001 | Murakami et al. | 439/77 |
| 6,840,789 | B2 * | 1/2005 | Shibata | 439/345 |
| 2012/0034811 | A1 * | 2/2012 | Ferderer | 439/370 |
| 2012/0071019 | A1 * | 3/2012 | Takamatsu | 439/370 |

* cited by examiner

*Primary Examiner* — Jean F Duverne
(74) *Attorney, Agent, or Firm* — Timothy M. Morella

(57) ABSTRACT

The male housing of the connector includes a flexible brace that extends in insertion direction of the male housing in a position separated from the main body and is connected to the main body at a front side and a backside of the insertion direction and has a latching block that fits into a latching hole formed on the side of a female housing, formed on a side separated from the main body of a midway part, where the midway part can be flexibly deformed so as to be close to the main body.

11 Claims, 5 Drawing Sheets

CONNECTOR

REFERENCE TO RELATED APPLICATIONS

The Present Disclosure claims priority to prior-filed Japanese Patent Application No. 2010-280021, entitled "Connector," filed on 16 Dec. 2010 with the Japanese Patent Office. The content of the aforementioned Patent Application is fully incorporated in its entirety herein.

BACKGROUND OF THE PRESENT DISCLOSURE

The Present Disclosure relates, generally, to a connector, and, more particularly, to a structure of a flexible brace provided on a male housing for a connector of a type in which a male housing is inserted into a female housing.

In general, with connectors of the type in which a male housing is inserted into a female housing, a flexible brace having a latching block is provided. An example of this is disclosed in Japanese Patent Application No. 2003-203717, the content of which is fully incorporated in its entirety herein. The flexible brace extends from the main body of the male housing in the insertion direction with the ability to flexibly deform in the direction to be closer to the main body. The latching block formed on the flexible brace uses the elastic recovery force to fit into a latching hole formed in the female housing.

In recent years, in conjunction with the miniaturization of electronic devices, a connector with a low height to be used thereby has been in demand. However, when simply lowering the height of a conventional connector as given above, there is the risk of not being able to obtain a sufficient elastic recovery force in the flexible brace.

On the other hand, as disclosed in Japanese Patent Application No. S61-063782, the content of which is also incorporated herein in its entirety, a connector is disclosed in which the flexible brace is connected to the main body at the front side and the rear side of the insertion direction. However, the connecting portion at the rear side is really nothing more than an auxiliary provision, the connecting portion at the rear side is narrower than the connecting portion of the front side, and the elastic recovery force in effect in the latching block is smaller at the connecting portion at the rear side. In this case, because the connecting portion at the front side has a larger elastic recovery force in effect in the latching block, a large insertion resistance occurs when inserting the male housing into the female housing as the flexible bridge contacts against the edge of the female housing.

SUMMARY OF THE PRESENT DISCLOSURE

A primary object of the Present Disclosure is to provide a connector that can have a low height while also reducing insertion resistance at the time of inserting a male housing into a female housing, and can secure a sufficient elastic recovery force in the fit of the latching block. In order to resolve the problem described above, the connector of the Present Disclosure is provided with a female housing and a male housing that inserts into the female housing.

The male housing includes a main body that holds one or a plurality of terminals, and a flexible brace that extends from the main body in the insertion direction of the female housing at a separated position. The flexible brace is connected to the main body at the front side and the rear side of the insertion direction and has a latching block that fits into a latching hole formed on the side of the female housing, formed on a side separated from the main body of a midway part, where the midway part can be flexibly deformed so as to approach the main body. With the flexible brace, the elastic recovery force in effect in the latching block by the front side brace part positioned at the front side in the insertion direction from the latching block is smaller than the elastic recovery force in effect in the latching block by the rear side brace part positioned at the rear side in the insertion direction from the latching block.

In the Present Disclosure, because the flexible brace is connected to the main body at the front side and rear side in the insertion direction, the necessary elastic recovery force for fitting the latching block into the latching hole can be secured from both the front side brace part and the rear side brace part even when lowering the height of the connector. Further, because the elastic recovery force in effect in the latching block by the front side brace part is smaller than that of the rear side brace part, the insertion resistance that occurs due to the front side brace part contacting the edge of the female housing can be reduced when inserting the male housing into the female housing. After the male housing is inserted into the female housing, sufficient elastic recovery force is exerted on the latching block by both the front side brace part and the rear side brace part.

Further, a part of the front side in the insertion direction of the front side brace part is narrower than a part of the rear side in the insertion direction of the rear side brace part. By this, the elastic recovery force in effect in the latching block by the front side brace part can be made to be smaller than that of the rear side brace part. In addition, because a part of the front side of the front side brace part is narrow, the male housing easily inserts into the female housing.

Further, the connecting part that is connected to the main body by curving to the side of the main body at the front end of insertion direction of the front side brace part is narrower than the connecting part that is connected to the main body by curving to the side of the main body at the rear end of the insertion direction of the rear end brace part. By this, the elastic recovery force in effect in the latching block by the front side brace part can be made smaller than that of the rear side brace part. In addition, because the connecting part provided on the front end of the front side brace part is narrow, the male housing easily inserts into the female housing.

Further, the thickness of the direction orthogonal to the extending direction of the flexible brace and the deformation direction of the elastic deformation of the part of the front side in the insertion direction of the front side brace part is thinner than the part of the rear side in the insertion direction of the rear side brace part. By this, the elastic recovery force in effect in the latching block by the front side brace part can be made to be smaller than that of the rear side brace part. In addition, because a part of the front side of the front side brace part is thin, the male housing easily inserts into the female housing.

Further, the thickness of the direction orthogonal to the extending direction of the flexible brace and the deformation direction of the elastic deformation of the connecting part that is connected to the main body by curving to the side of the main body at the front end of insertion direction of the front side brace part is thinner than the connecting part that is connected to the main body by curving to the side of the main body at the rear end of the insertion direction of the rear end brace part. By this, the elastic recovery force in effect in the latching block by the front side brace part can be made to be smaller than that of the rear side brace part. In addition, because the connecting part provided on the front end of the front side brace part is thin, the male housing easily inserts into the female housing.

In addition, a pressed part that juts out in the direction away from the main body is formed on the side away from the main body of the rear side brace part. Thus, the fit of the latching block into the latching hole can be released by pressing the pressed part in the direction to be closer to the main body.

Further, the gap between the main body and the portion on which the pressed part of the flexible brace is formed may be larger than the gap between the main body and the portion on which the latching block of the flexible brace is formed. By this, the displacement distance of the pressed part can be sufficiently secured.

Further, of the surfaces that face the main body of the rear side brace part, the portion between the pressed part and the latching block may be positioned to the side near the main body or to the side away from the main body in relation to an extended line of the surface that faces the main body of the front side brace part. By doing so, the position where the flexible brace has the most bend can be adjusted in the insertion direction when the pressed part is pressed. For example, as the position where the flexible brace has the most bend gets closer to the latching block, releasing the fit between the latching block and the latching hole becomes easier.

Further, a raised part that extends in the insertion direction is formed on the main body of the male housing, and a guide groove that extends in the insertion direction to guide the raised part is formed on the female housing, and when the male housing is inserted into the female housing, a pair of edge parts that form the guide groove are positioned so as to interpose the raised part in the displacement direction of the flexible brace. Thus, the releasing of the fit between the latching block and the latching hole can be suppressed when a force in the displacement direction of the flexible brace is applied to the male housing.

In addition, the raised part is preferably formed more rearward of the insertion direction then at least the latching block. By doing so, the releasing of the fit between the latching block and the latching hole can be particularly suppressed when a force in a rotational direction within a plane that includes the displacement direction of the flexible brace is applied to the male housing.

Accordingly, the connector of the Present Disclosure is provided with a female housing and a male housing that inserts into the female housing. The male housing includes a main body that holds one or a plurality of terminals, and a flexible brace that extends from the main body in the insertion direction of the female housing at a separated position. The flexible brace is connected to the main body at the front side and the rear side of the insertion direction and has a latching block that fits into a latching hole formed on the side of the female housing, formed on a side separated from the main body of a midway part, where the midway part can be flexibly deformed so as to be close to the main body. With the flexible brace, a part of the front side of the insertion direction of the front side brace part positioned at the front side in the insertion direction from the latching block is narrower than a part of the rear side of the insertion direction of the rear side brace part positioned at the rear side in the insertion direction from the latching block.

With the Present Disclosure, because the flexible brace is connected to the main body at the front side and rear side in the insertion direction, the necessary elastic recovery force for fitting the latching block into the latching hole can be secured from both the front side brace part and the rear side brace part even when lowering the height of the connector. Further, because the elastic recovery force in effect in the latching block by the front side brace part is smaller than that of the rear side brace part, the insertion resistance that occurs due to the front side brace part contacting the edge of the female housing can be reduced when inserting the male housing into the female housing. After the male housing is inserted into the female housing, sufficient elastic recovery force is exerted on the latching block by both the front side brace part and the rear side brace part. In addition, because a part of the front side of the front side brace part is narrow, the male housing easily inserts into the female housing.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
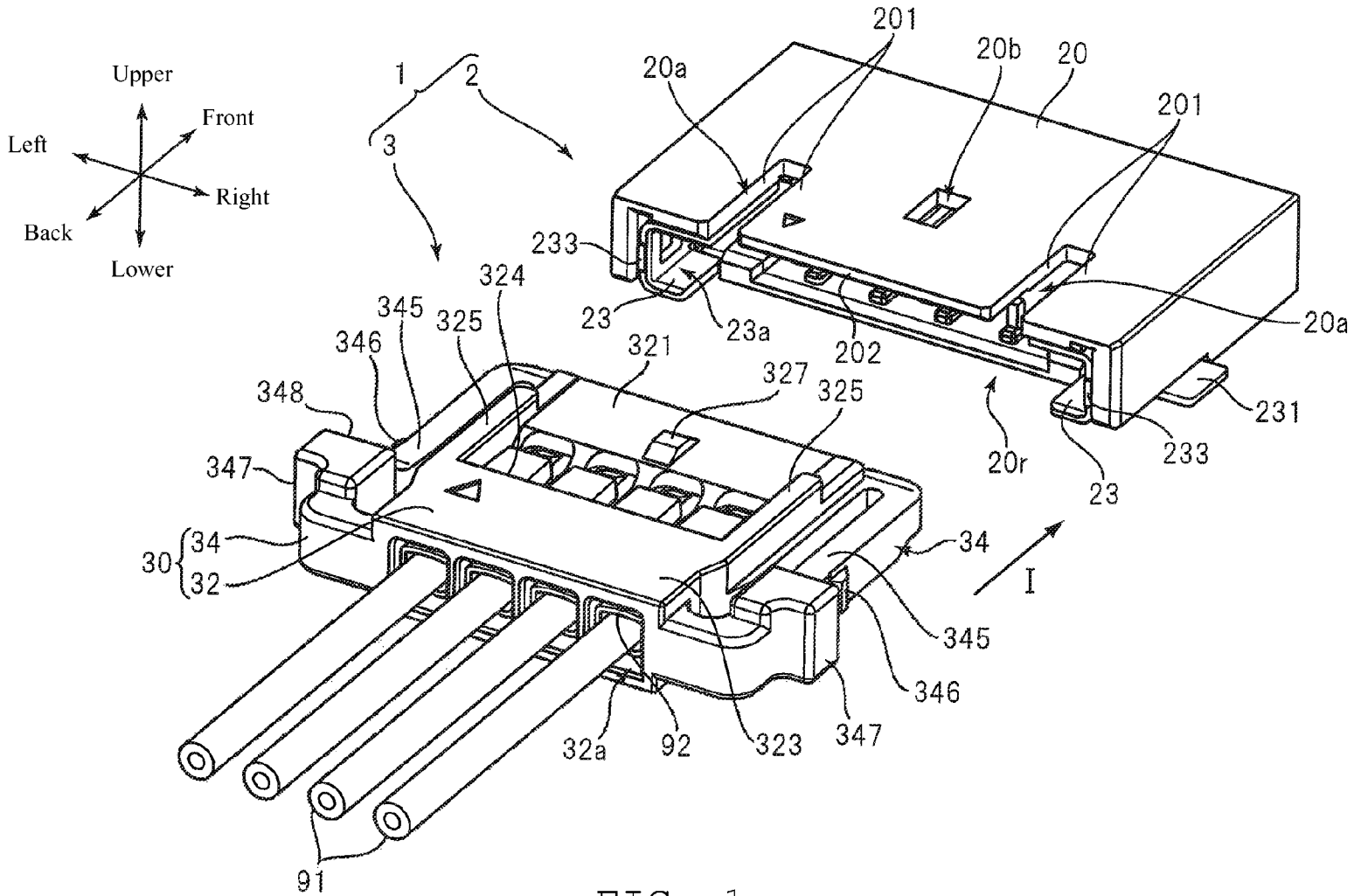
FIG. 1 is a perspective view of a pre-connected state of the connector according to the Present Disclosure.
Figure 2:
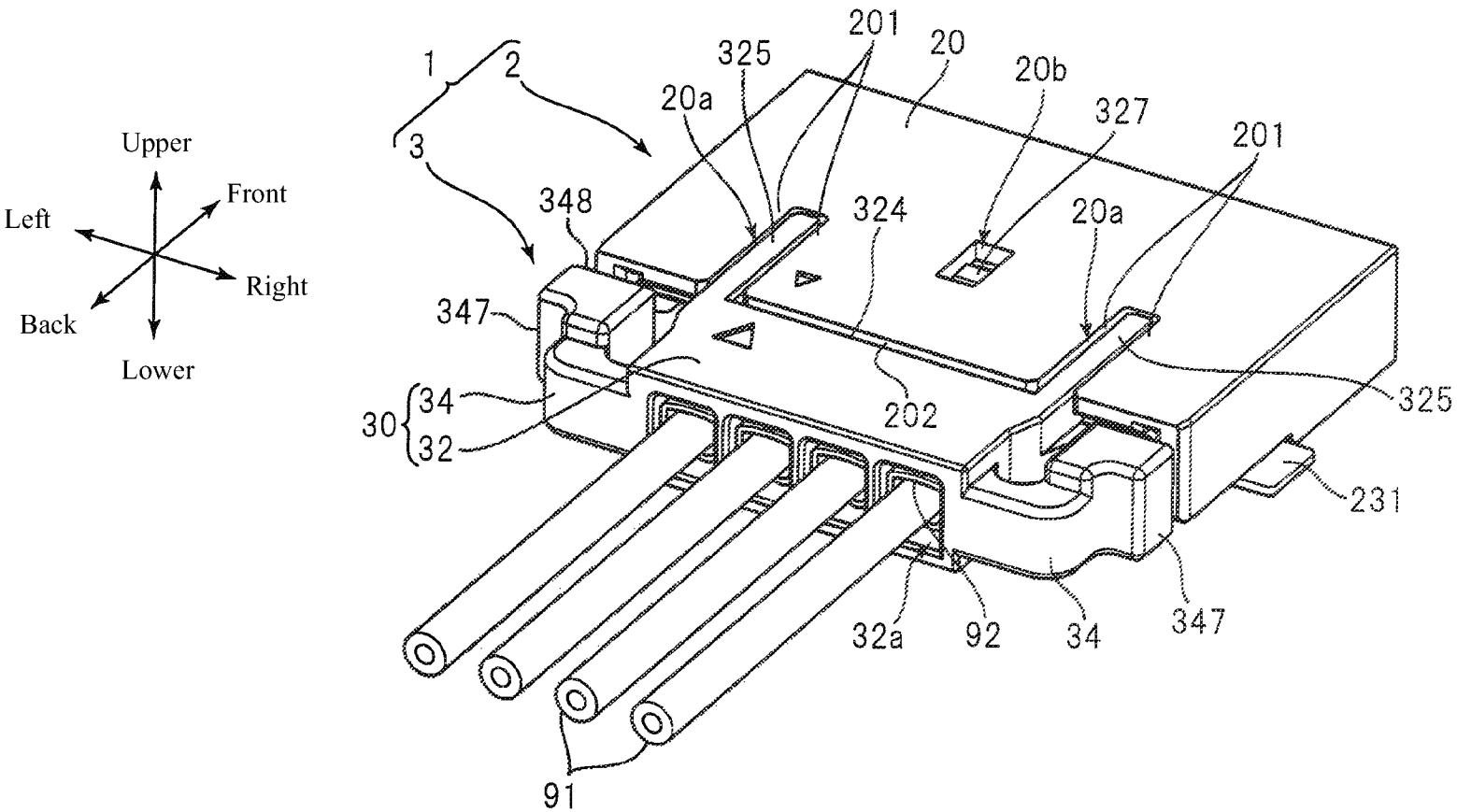
FIG. 2 is a perspective view of a post-connected state of the connector of FIG. 1.

Connector 1, as illustrated in FIGS. 1-2, is provided with a female connector 2 and a male connector 3 inserted therein. Arrow I in FIG. 1 indicates the insertion direction. Hereinafter, the insertion direction of the male connector 3 is the front direction and the extraction direction is the rear direction. Further, of the directions that are orthogonal to the insertion direction of the male connector 3, the direction in which the width of the male connector 3 is longer is the lateral direction, and the direction in which the width is shorter is the vertical direction.

The female connector 2 is provided with a female housing 20 formed from an insulating material, and support fittings 23 made of a folded metal thin plate and is attached onto a circuit substrate (not illustrated). The female housing 20 is short in the vertical direction and is formed in the shape of a flat rectangular box with the inside hollow, and an insertion opening 20*r* that opens to the rear is formed on the back side part.

A plurality of terminals not illustrated is housed on the inside of the female housing 20.

These terminals are electrically connected to a plurality of terminals formed on the top surface of the circuit substrate (not illustrated). Note that, without restriction to this example, terminals formed on the top surface of the circuit substrate may be used as the terminals for connection without housing the terminals inside the female housing 20.

The support fittings 23 are fitted to the left and right end parts on the inside of the female housing 20. The support fittings 20 include and attaching part 231 that extends outward from the left and right side walls of the female housing 20, and these attaching parts 231 are bonded to the circuit substrate (not illustrated). The back end part of the support fitting 20 is bent in a U shape, and latching holes 23*a* are formed at the portion that overlaps with the left and right side walls of the female housing 20. A plurality of guide grooves 20*a* that extend in the front to back direction with the back end open and penetrate in the vertical direction are formed separated in the left and right directions to the back half part of the upper wall of the female housing 20. Further, a rectangular latching groove 20*b* that penetrates in the vertical direction is formed in the center part of the upper wall of the female housing 20.

The male connector 3 is provided with a male housing 30 formed from an insulating material. The male housing 30 is provided with a schematically plate shaped main body 32 that is short in the vertical direction and flexible braces 34 provided on both left and right sides of the main body 32. A plurality of insertion holes 32*a* is formed on the back end of the main body 32, and terminals 92 are attached to the tip ends of wires 91 are inserted into the insertion holes 32*a*.

Figure 3:
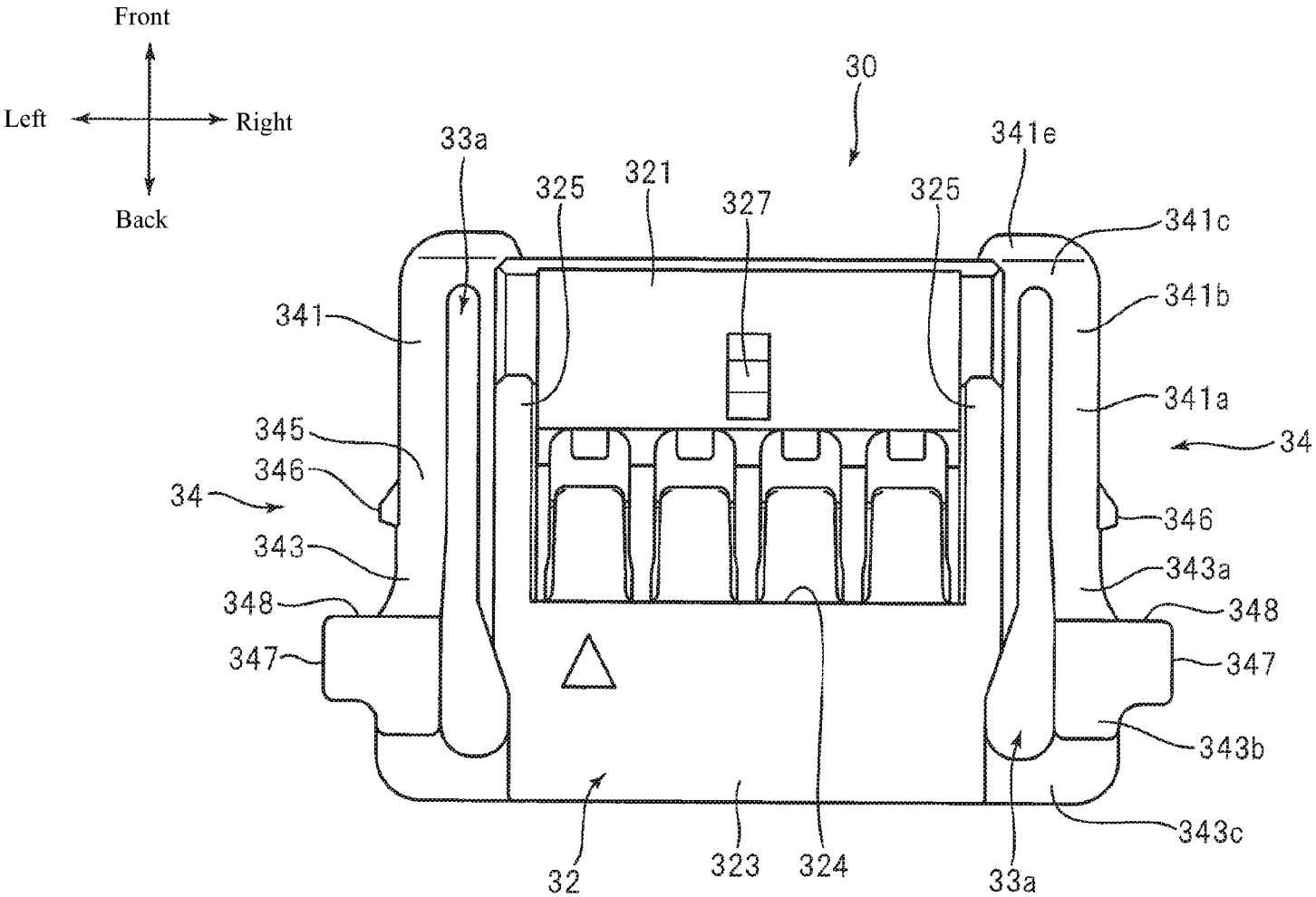
FIG. 3 is a plan view of a female housing contained in the connector of FIG. 1.
Figure 4:
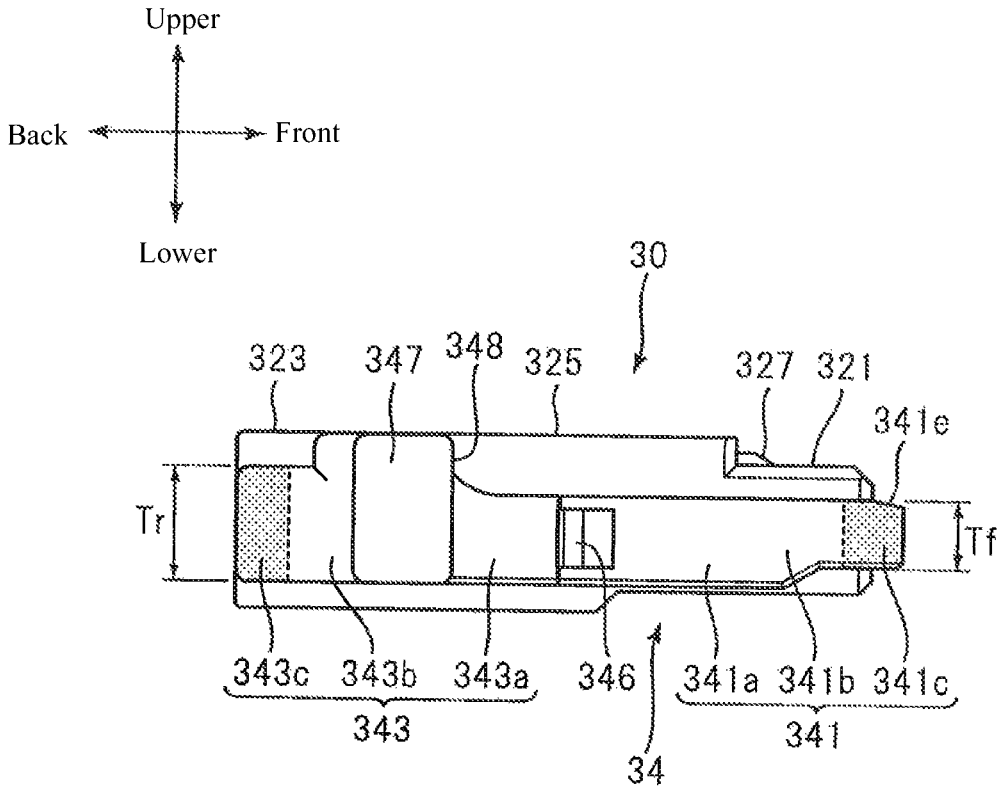
FIG. 4 is a lateral view of a female housing in which the connector of FIG. 1 is contained.

As illustrated in FIGS. 3-4, the main body 32 of the male housing 30 is provided with a front part 321 and a rear part 323 that is thicker than the front part 321. Of these, the front part 321 is inserted into the female housing 20, and the rear part 323 is not inserted into the female housing 20 (see FIGS. 1-2). At this time, the front end 324 of the rear part 323 mutually faces the rear edge 202 of the female housing 20. Note that the main body 32 holds the terminals 92, and as long as contact can be made with the terminals of the other part, the shape thereof is not particularly restricted.

Raised parts 325 that are extended in the front-rear direction and protrude upwards are formed on the left and right end parts of the upper surface of the main body 32, and are successively formed with the rear part 323 and extend from the rear part 323 more forward than the latching block 346 (described below). Further, raised parts 327 having slanted surfaces to the front and rear are formed in the center of the front side of the top surface of the main body 32.

The flexible braces 34 extend in the front to rear direction in a position that is separated to the outside of the left and right direction from the main body 32, and gaps 33*a* are formed between the flexible braces 34 and the main body 32. The front end part and the backend part of these flexible braces 34 curve to the side of the main body 32 and are integrally connected to the main body 32. By so doing, the flexible braces 34 are made with the ability to flexibly deform to the inside in the left and right direction so that the midway part 345 can get close to the main body 32, and they are made with the ability to elastically recover to the outside in the left and right directions so that the midway part 345 can separate from the main body 32. The midway part 345 is positioned between the front end part connected to the main body 32 of the flexible brace 34 and the backend part.

The latching blocks 346 that project to the outside in the left-right direction and are formed on the surface of the outside of the left-right direction of the midway parts 345 of the latching blocks 34. Further, pressed parts 347 that jut out to the outside and the left-right direction further then the latching blocks 346 are formed to the rear of the latching blocks 346. The pressed parts 347 receive pressure, and have a thickness in the vertical direction that is larger compared to the portion that is more forward than the pressed parts 347 of the flexible braces 34. The position in the front to rear direction of the front end 348 of the pressed part 347 is nearly the same as the front end 324 of the rear part 323 of the main body 32, and when the male housing 30 is inserted into the female housing 20, the front end 348 of the pressed part 347 also mutually faces the rear edge 202 of the female housing 20 (see FIGS. 1-2). Here, in regard to the flexible braces 34, the portion to the front side of the latching block 346 is the front side brace part 341, and the portion to the rear side of the latching block 346 is the rear side brace part 343.

Further, the front side brace part 341 includes an extending part 341*a* that extends in the front to rear direction forward of the latching block 346, a tip end part 341*b* placed forward of the extending part 341*a* and having a reduced thickness moving toward the front, and a connecting part 341*c* that is connected to the main body 32 by curving to the side of the main body 32 from the tip end part 341*b*. Because the thickness of the tip end part 341*b* is reduced and the connecting part 341*c* is thinly formed, insertion into the female connector 2 is made easy. Further, because a tapered surface 341*e* is formed on the front side of the upper surface of the connecting part 341*c*, insertion into the female connector 2 is further made easier. In the present example, the connecting part 341*c*, of the front side brace part 341, that is connected to the main body 32 indicates the portion that is curved to face the side of the main body 32 from the extending direction of the flexible brace 34. The curved connecting part 341*c* is the primary source of the elastic recovery force of the front side brace part 341.

The rear side brace part 343 includes an extending part 343*a* that extends in the front to rear direction between the latching block 346 and the pressed part 347, a thick part 343*b* placed rearward of the pressed part 347 and having a thickness in the vertical direction similar to that as the pressed part 347, and a connecting part 343*c* that is connected to the main body 32 by curving to the side of the main body 32 from the thick part 343*b*. The back end part of the extending part 343*a* widens upward and outward in the lateral direction to get close to the pressed part 347. Thus, the deformation of the surroundings of the pressed part 347 can be suppressed when the pressed part 347 is pressed because the front and rear of the pressed part 347 is formed to be comparatively thicker. Therefore, a sufficient reactive force can be exerted even if the pressed part 347 receives an unintentional external force. Here, the connecting part 343*c*, of the rear side brace part 343, connected to the main body 32 indicates the portion that is curved to face the side of the main body 32 from the extending direction of the flexible brace 34. The curved connecting part 343*c* is the primary source of the elastic recovery force of the rear side brace part 343.

When comparing the side base parts 341, 343, the tip end part 341*b* and the connecting part 341*c* of the front side brace part 341 is narrower and the thickness in the vertical direction is thinner than the thick part 343*b* and the connecting part 343*c* of the rear side brace part 343. As a result, the elastic recovery force and effect in the latching block 346 by the front side brace part 341 is smaller than the elastic recovery force in effect in the latching block 346 by the rear side brace part 343. The elastic recovery force can be adjusted primarily by the fatness and thickness of the connecting parts 341*c*, 343*c*, and without being limited to that, also the elastic recovery force can also be adjusted by the fatness and the thickness of the linear portions of the flexible brace 34, which is to say the tip end part 341*b* and the thick part 343*b*.

In addition, when comparing the mutual connecting parts 341*c*, 343*c*, the thickness in the front to rear direction of both are nearly the same, while the thickness Tf in the vertical direction of the connecting part 341*c* of the front side brace part 341 is smaller than the thickness Tr in the vertical direction of the connecting part 343*c* of the rear side brace part 343*c*. Therefore, the connecting part 341*c* of the front side brace part 341 is narrower, which is to say that the cross-sectional area is smaller, than the connecting part 343*c* of the rear side brace part 343. The cross section of the connecting parts 341*c*, 343*c* in FIG. 4 is shown by the hatching of the dotted line.

Without being limited to this example, at least one of either the thickness in the front to rear direction or the thickness in the vertical direction of the connecting part 341*c* of the front side brace part 341 is to be smaller than the connecting part 343*c* of the rear side brace part 343. Furthermore, the cross-sectional area of the connecting part 341*c* of the front side brace part 341 need not be smaller than the connecting part 343*c* of the rear side brace part 343*c*. As long as the relationship of the elastic recovery force is satisfied as described above, the shape and size of the front side brace part 341 and the rear side brace part 343 are not particularly restricted.

Figure 5:
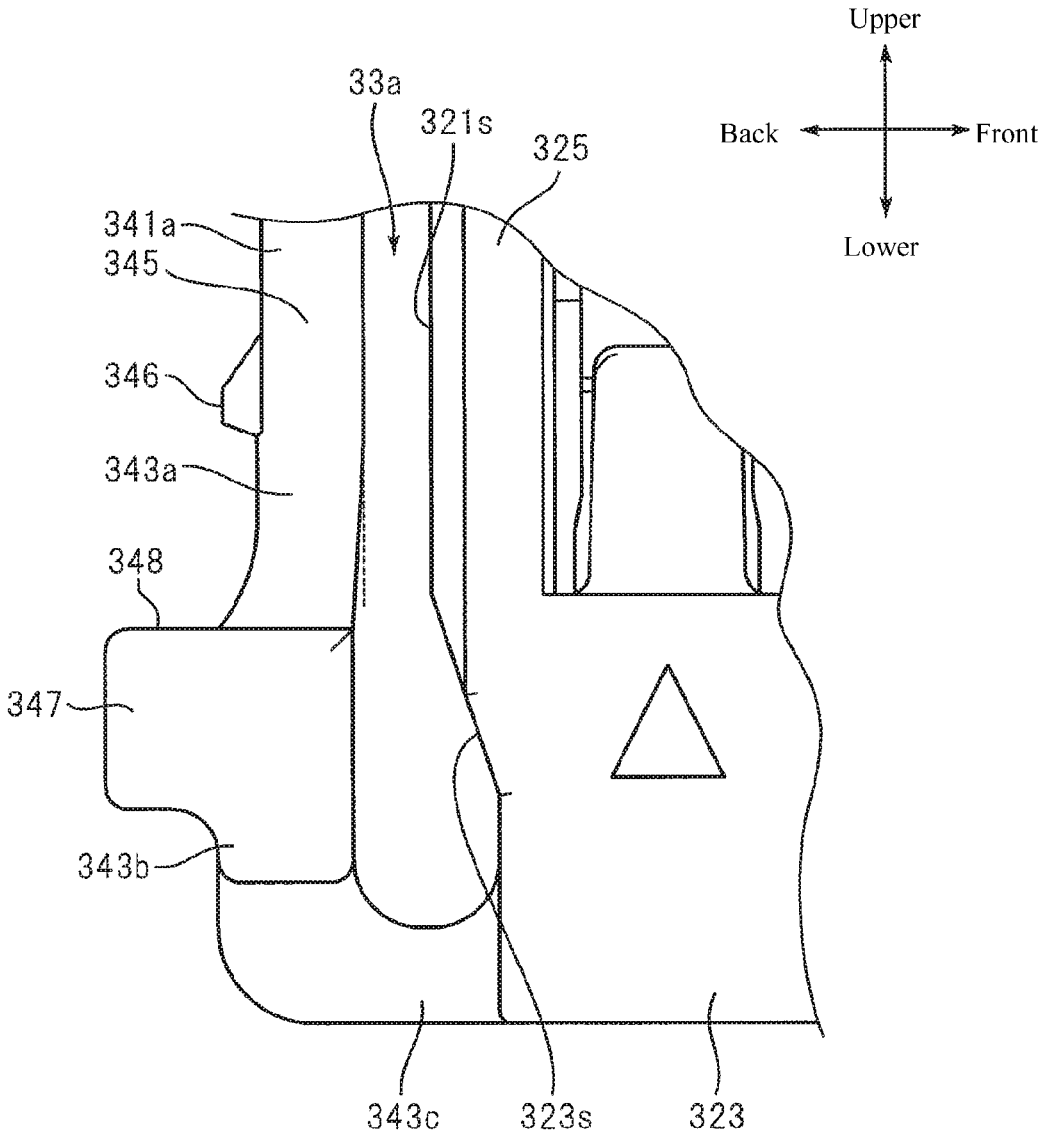
FIG. 5 is a magnified view of the essential parts of FIG. 3.

As illustrated in FIG. 5, of the left and right lateral walls of the main body 32, the portion 323*s* that faces the undersurface (the surface inside in the left-right direction) of the pressed part 347 of the flexible brace 34 are further sunken to the inside in the left and right direction in the portion 321*s* that faces the undersurface of the midway part 345. Specifically, the portion 323*s* that faces the under surface of the press part 347 has a tapered surface that slants to the inside in the left-right direction while moving to the rear. Without being limited to this, a height difference or the like may be employed. By providing this type of shape, the gap between the undersurface of the pressed part 347 and the main body 32 is larger than the gap between the undersurface of the midway part 345 and the main body 32. According to this, because the displacement distance of the pressed part 347 is sufficiently secured, it becomes possible to provide a design so that the undersurface of the midway part 345 contacts the side surface of the main body 32 earlier than the undersurface of the pressed part 347 when the pressed part 347 is pressed. Note the undersurface of the pressed part 347 need not contact the side surface of the main body 32.

Further, as illustrated in FIG. 5, the undersurface of the extending part 343*a* of the rear side brace part 343 is positioned slightly to the outside in the left and right direction in relation to an extension line (dotted line in FIG. 5) where the undersurface of the extending part 341*a* of the front side brace part 341 is extended in that extending direction. Specifically, the under surface of the extending part 343*a* of the rear side brace part 343 is at a slight angle to the extended line of the undersurface of the extending part 341*a* of the front side brace part 341 and extends in a direction to gradually separate from the main body 32 while moving rearward. Without being limited to this, a step may be formed between the undersurface of the extending part 343*a* of the rear side brace part 343 and the undersurface of the extending part 341*a* of the front side brace part 341. By doing this, the position where the flexible brace 34 has the most bend can be slid forward when the pressed part 347 is pressed. In other words, because the undersurface of the flexible brace 34 is raised at the position of the latching block 346 to face to the inside in the left and right direction in the same manner as the pressing direction of the pressed part 347, the acting force is easily transferred forward when the pressed part 347 is pressed. Therefore, the relative front side of the flexible brace 34 becomes easy to bend.

Meanwhile, when the undersurface of the extending part 343*a* of the rear side brace part 343 is positioned slightly to the inside in the left and right direction in relation to the extension line (dotted line in FIG. 5) of the undersurface of the extending part 341*a* of the front side brace part 341, the position where the flexible brace 34 has the most bend can be slid rearward. In other words, because the undersurface of the flexible brace 34 is raised at the position of the latching block 346 to face to the outside in the opposite left and right direction to the pressing direction of the pressed part 347, the acting force is difficult to transfer forward when the pressed part 347 is pressed. Therefore, the relative rear side of the flexible brace 34 becomes easy to bend. By doing this, the position where the flexible brace 34 has the most bend can be adjusted in the front to rear direction and can be made close to the latching block 346. It is preferred that the position where the flexible brace 34 has the most bend is near to the position of the latching block 346.

The female connector 2 and the male connector 3 configured in this manner can be attached together as illustrated in FIGS. 1-2. Specifically, when the male housing 30 is inserted into the female housing 20, first, the midway part 345 of the flexible brace 34 elastically deforms so as to get close to the main body 32 due to the latching block 346 of the flexible brace 34 contacting the back end 233 of the support fitting 23. Next, when the pressed part 347 of the flexible brace 34 and the rear part 323 of the main body 32 gets close to the rear edge 202 of the female housing 20, the midway part 345 of the flexible brace 34 elastically recovers so as to separate from the main body 32 and the latching block 346 formed on the midway part 345 fits into the latching hole 23*a* formed in the support fitting 23. By doing this, the attachment of the connectors 2, 3 is complete, and the terminals 92 held in the male housing 30 connect with the terminals not illustrated that are housed in the female housing 20. Without being limited to this example, the terminals 92 held in the male housing 30 may also have direct contact with the terminals of the circuit substrate not illustrated attached in the female connector 2.

According to the description given above for the flexible brace 34 of the male housing 30 of the present embodiment, the elastic recovery force in effect in the latching block 346 by the front side brace part 341 is made to be smaller than the elastic recovery force in effect in the latching block 346 by the rear side brace part 343. Therefore, when inserting the male housing 30 into the female housing 20, the insertion resistance is small and insertion is easy even if the front side brace part 341 of the flexible brace 34 contacts the back end 233 of the support fitting 23. Meanwhile, after the male housing 30 is inserted into the female housing 20, the fit between the latching block 346 and the latching hole 23*a* is maintained because a sufficient elastic recovery force is exerted on the latching block 346 by both the front side brace part 341 and the rear side brace part 343. Therefore, the overall height of the connector 1 can be lower.

Further, when the male housing 30 inserts into the female housing 20, the raised parts 325, 327 formed on the upper surface of the male housing 30 are respectively inserted into the guide groove 20*a* and the latching groove 20*b* formed on the upper wall of the female housing 20. Also, a pair of edge parts 201 that forms the guide groove 20*a* of the female housing 20 is arranged in the left-direction (the deformation direction of the flexible brace 34), so as to interpose the raised part 325. Therefore, it becomes possible to suppress the unintentional release of the fit between the latching block 346 and the latching hole 23*a* even when a force in a rotational direction in a plane that includes the front-rear and left-right directions is exerted on the male housing 30 by, for example, the wiring 91 that extends rearward from the male housing 20 being pulled laterally because the raised part 325 contacts against the edge part 201 of the guide groove 20*a*. It is preferable that the raised part 325 is formed more rearward than the latching block 346 of the flexible brace 34 when suppressing release in this manner. Further, the further the two raised parts 325 are separated in the left-right direction, the more preferred the configuration.

When extracting the male housing 30 from the female housing 20, the pressed part 347 formed on the flexible brace 34 of the male housing 30 receives pressure in the direction to move closer to the main body 32 by person's finger or the like. By doing this, extraction of the male housing 32 is possible because the fit between the latching block 346 and the latching hole 23*a* is released. With the flexible brace 34 of the male housing 30 of the present embodiment, the elastic recovery force in effect in the latching block 346 by the rear side brace part 343 is larger than the elastic recovery force in effect in the latching block 346 by the front side brace part 341, and the surroundings of the press part 347 is difficult to deform. Therefore, a sufficient reactive force can be exerted even if the pressed part 347 receives an unintentional external force.

While a preferred embodiment of the Present Disclosure is shown and described, it is envisioned that those skilled in the art may devise various modifications without departing from the spirit and scope of the foregoing Description and the appended Claims.

What is claimed is:

1. A connector, the connector comprising:

a female housing; and a male housing, the male housing being inserted into the female housing;

wherein:

the male housing comprises:

a main body that holds one or a plurality of terminals; and a flexible brace that extends in insertion direction of the male housing in a position separated from the main body and is connected to the main body at a front side and a rear side of the insertion direction and has a latching block that fits into a latching hole formed on the side of the female housing, formed on a side away from the main body of a midway part, where the midway part can be flexibly deformed so as to be close to the main body; and with the flexible brace, the elastic recovery force in effect in the latching block by the front side brace part positioned at the front side in the insertion direction from the latching block is smaller than the elastic recovery force in effect in the latching block by the rear side brace part positioned at the rear side in the insertion direction from the latching block.

2. The connector of claim 1, wherein a part of the front side in the insertion direction of the front side brace part is narrower than a part of the rear side in the insertion direction of the rear side brace part.

3. The connector of claim 2, wherein a connecting part that is connected to the main body by curving towards the side of the main body at the front end of the insertion direction of the front side brace part is narrower than a connecting part that is connected to the main body by curving to the side of the main body at the rear end of the insertion direction of the rear end brace part.

4. The connector of claim 3, wherein the thickness of the direction orthogonal to the extending direction of the flexible brace and the deformation direction of the elastic deformation of a part of the front side in the insertion direction of the front side brace part is thinner than a part of the rear side in the insertion direction of the rear side brace part.

5. The connector of claim 4, wherein the thickness of the direction orthogonal to the extending direction of the flexible brace and the deformation direction of the elastic deformation of the connecting part that is connected to the main body by curving to the side of the main body at the front end of insertion direction of the front side brace part is thinner than the connecting part that is connected to the main body by curving to the side of the main body at the rear end of the insertion direction of the rear end brace part.

6. The connector of claim 5, wherein a pressed part that juts out in the direction away from the main body is formed on the side away from the main body of the rear side brace part.

7. The connector of claim 6, wherein the gap between the main body and the portion on which the pressed part of the flexible brace is formed is larger than the gap between the main body and the portion on which the latching block of the flexible brace is formed.

8. The connector of claim 7, wherein with the surfaces that face the main body of the rear side brace part, the portion between the pressed part and the latching block is positioned to the side near the main body or to the side away from the main body in relation to an extended line of the surface that faces the main body of the front side brace part.

9. The connector of claim 8, wherein:

a raised part that extends in the insertion direction is formed on the main body of the male housing;

a guide groove that extends in the insertion direction to guide the raised part is formed on the female housing; and when the male housing is inserted into the female housing, a pair of edge parts that form the guide groove are positioned so as to interpose the raised part in the displacement direction of the flexible brace.

10. The connector of claim 9, wherein the raised part is formed more rearward in the insertion direction than at least the latching block.

11. A connector, the connector comprising:

a female housing; and a male housing, the male housing being inserted into the female housing;

wherein:

the male housing comprises:

a main body that holds one or a plurality of terminals; and a flexible brace that extends in the insertion direction of the male housing in a position separated from the main body and is connected to the main body at a front side and a rear side of the insertion direction and has a latching block that fits into a latching hole formed on the side of the female housing, formed on a side away from the main body of a midway part, where the midway part can be flexibly deformed so as to be close to the main body; and with the flexible brace, a part of the front side of the insertion direction of the front side brace part positioned at the front side in the insertion direction from the latching block is narrower than a part of the rear side of the insertion direction of the rear side brace part positioned at the rear side in the insertion direction from the latching block.

* * * * *